US007611222B2

(12) United States Patent
Cray et al.

(10) Patent No.: US 7,611,222 B2
(45) Date of Patent: Nov. 3, 2009

(54) NOZZLE SHIELD ASSEMBLY

(75) Inventors: Teresa M. Cray, Corvallis, OR (US); Steven T. Castle, Philomath, OR (US); Jefferson P. Ward, Brush Prairie, WA (US); Marco Roccatti, Settimo Torinese (IT); Alberto Albertin, Ivrea (IT)

(73) Assignee: Hewlett-Packard Development Company, L.P., Houston, TX (US)

( * ) Notice: Subject to any disclaimer, the term of this patent is extended or adjusted under 35 U.S.C. 154(b) by 387 days.

(21) Appl. No.: 10/960,478

(22) Filed: Oct. 6, 2004

(65) Prior Publication Data

US 2006/0071967 A1 Apr. 6, 2006

(51) Int. Cl.
*B41J 2/165* (2006.01)

(52) U.S. Cl. ..... 347/29

(58) Field of Classification Search ..... 347/22, 347/29, 84–86, 108; 206/1.9, 441, 497, 523, 206/701, 722, 813

See application file for complete search history.

(56) References Cited

U.S. PATENT DOCUMENTS

| | | | | |
|---|---|---|---|---|
| 5,239,805 | A | 8/1993 | Uchida et al. | |
| 5,701,995 | A * | 12/1997 | Higuma et al. | 206/205 |
| 5,831,652 | A * | 11/1998 | Hinami et al. | 347/86 |
| 6,019,451 | A | 2/2000 | Kawaguchi et al. | |
| 6,588,875 | B1 * | 7/2003 | Kleinhammer | 347/29 |
| 6,626,515 | B2 | 9/2003 | Silverbrook et al. | |
| 6,629,749 | B2 | 10/2003 | Miyauchi et al. | |
| 6,634,732 | B2 | 10/2003 | Farr et al. | |
| 6,641,248 | B2 | 11/2003 | Mitsui et al. | |
| 2002/0071014 | A1 * | 6/2002 | Matsumoto et al. | 347/87 |

* cited by examiner

*Primary Examiner*—Stephen D Meier
*Assistant Examiner*—Geoffrey Mruk

(57) ABSTRACT

A nozzle shield assembly includes a band of material having a tag end, a standing end, a first side, and a second side; wherein the second side is at least partially folded against itself, and the standing end is configured to cover a nozzle of a print cartridge.

21 Claims, 6 Drawing Sheets

NOZZLE SHIELD ASSEMBLY

BACKGROUND

Frequently, it is desirable to generate a hardcopy of a document or data set that is produced or stored on a personal computer or server. Consequently, a wide variety of printers and printing devices have been developed that can receive a print job from a host computer and produce a hardcopy of the document or data represented by that print job.

One example of a printing device is an inkjet printer. A typical inkjet printer has a print head including an array of precisely formed nozzles. Behind each nozzle is an ink collection chamber that receives liquid ink from a reservoir. Pressure is selectively created in the collection chambers to drive a small amount of ink through the respective nozzle. The ejected ink is typically deposited on a sheet of print medium, such as a piece of paper. The ink ejection may be driven by thermally, mechanically, electrically, magnetically, and/or piezo-electrically activated means. Activation of the nozzles to eject drops of ink occurs in response to a signal generated by a processor that is processing the print job. By properly sequencing the activation of the nozzles in the array in response to signals corresponding to the print job, characters and/or images are formed on the print medium as the print head is moved with respect to the print medium.

Inkjet printers frequently utilize replaceable ink cartridges. These replaceable cartridges typically include the reservoir or supply of ink and the print head with the array of nozzles. In some ink cartridge, there may be nozzles that direct a flow of ink to a remote print head. In either case, it may be desirable to provide a covering, such as nozzle tape, over the nozzles of the cartridge to prevent the ink contained therein from leaking and to prevent damage to the nozzles. Before operation, this nozzle tape must be removed in order for the cartridge to operate properly.

BRIEF DESCRIPTION OF THE DRAWINGS

The accompanying drawings illustrate various embodiments of the present apparatus and method and are a part of the specification. The illustrated embodiments are merely examples of the present apparatus and method and do not limit the scope of the disclosure.

Throughout the drawings, identical reference numbers designate similar, but not necessarily identical, elements.

DETAILED DESCRIPTION

Figure 1:
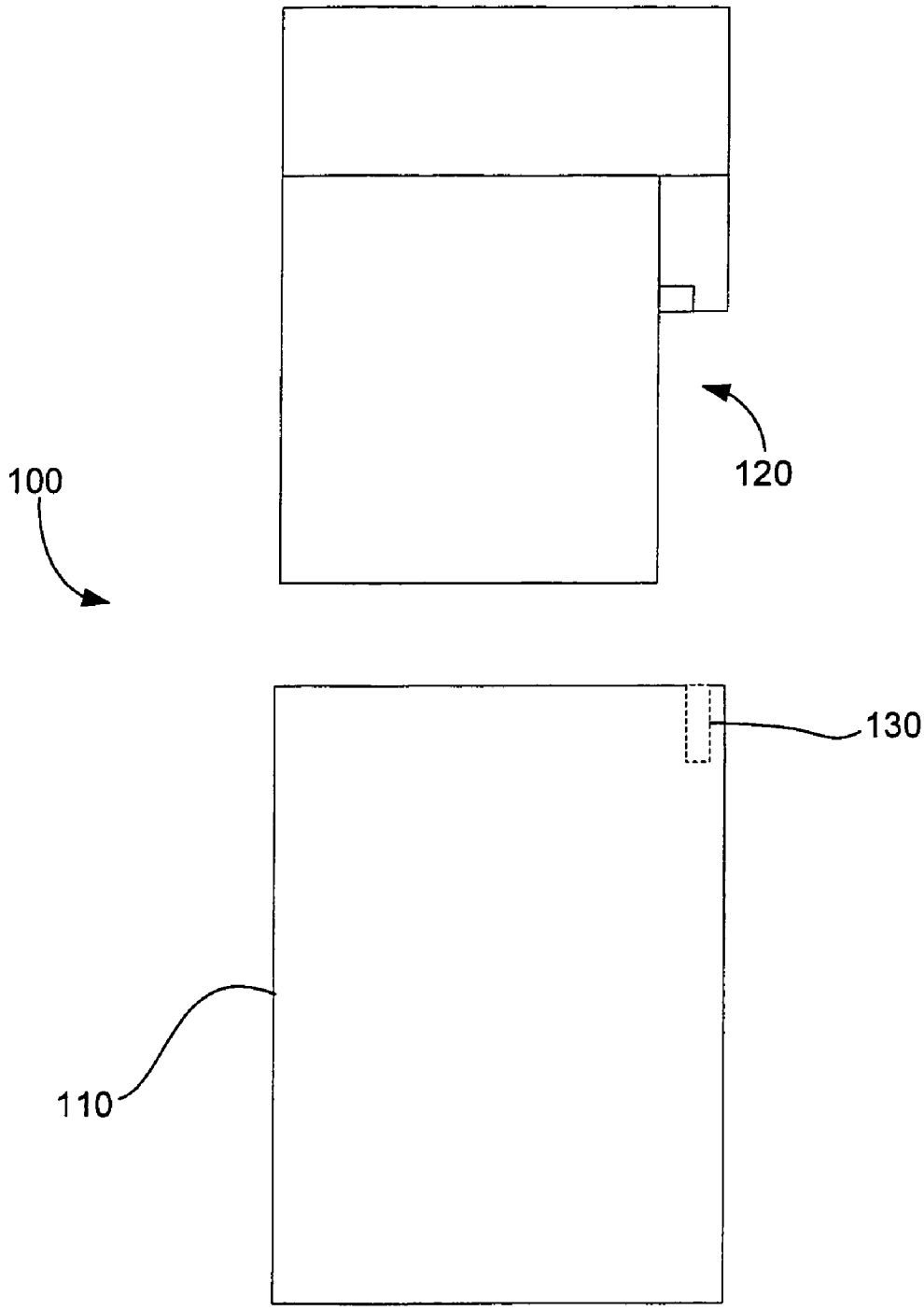
FIG. 1 illustrates an exploded view of an exemplary printing device having a consumables container.

Recent efforts have been directed at decreasing the size of printing devices. In addition, efforts have also been directed at increasing the convenience with which the ink cartridge and the media supply, such as a media tray can be accessed and replaced. As a result, some systems make use of a removable consumables container that incorporates both a replaceable ink cartridge and a supply of print media in a single unit.

In such systems, the ink cartridge is partially or substantially enclosed within the consumables container housing. This configuration limits the visibility of the nozzle tape described above. As a result, end users may fail to remove the nozzle tape before attempting to couple the consumables container to the printing device. This failure to remove the nozzle tape may result in damage to the nozzle tape. The nozzle tape may also be damaged prior to installation of the consumables container due to contact with other consumables container components. Once the tape is damaged, it may be difficult or even impossible to completely remove the nozzle tape and clear the nozzles.

The present specification discloses a nozzle shield assembly that protects the nozzle tape from damage. The present specification also discloses an indicator for helping a user remember to remove the nozzle tape before attempting to use the consumables container.

The nozzle shield assembly includes a band of material, such as nozzle tape, having a tag end, a standing end, a first side, and a second side. The second side is non-adhesive and is at least partially folded against itself. The tag end is used to remove the nozzle shield assembly, while the standing end is used to cover a nozzle array of a print cartridge.

In addition, the nozzle shield assembly may include a cap shield coupled to the tag end of the band of material. The cap shield protects the material or nozzle tape from abrasion or other damage that may be caused by contact with a cap or other component of the consumables container before the consumables container is installed. Protection of the nozzle tape by the cap shield further improves the reliability and ease with which the nozzle shield assembly can be removed.

An indicator can be included to indicate that the nozzle tape is attached to a cartridge assembly. The indicator may be coupled to the nozzle tape and then wrapped around the cartridge assembly and a consumables container housing of the consumables container to which the cartridge assembly is attached. Such an indicator may be visible from all angles of the consumables container. This visibility reduces the possibility that a user will unintentionally attempt to couple the consumables container to an assembly housing of the printing device while the nozzle shield assembly is still attached.

As used herein and in the appended claims, the term "ink" is used to refer to any marking fluid dispensed by a printing device, such as toner, colorant, ink, etc. A "cartridge assembly" is any device or apparatus configured to contain a supply of ink and to make the ink available for printing operations. A "nozzle" shall be broadly understood as any structure that can individually and selectively eject a drop of ink or otherwise dispense ink for printing operations. In addition, a "consumables container housing" shall be broadly understood as any structure to which a cartridge assembly may be coupled or in which a cartridge assembly may be housed.

In the following description, for purposes of explanation, numerous specific details are set forth in order to provide a thorough understanding of the present method and apparatus.

It will be apparent, however, to one skilled in the art that the present method and apparatus may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Exemplary Structure

FIGS. 1-3 illustrate a printing device, a consumables container, and their components. FIG. 1 illustrates an exploded view of a printing device (100) that generally includes an assembly housing (110) and a consumables container (120). The assembly housing (110) of the printing device (100) may include, for example, a processor, a memory, a connection for receiving print jobs from a host computer, a print media handling system, etc. The consumables container (120) includes, for example, supplies of consumables such as print media, an ink cartridge assembly, etc. As a result, the consumables container (120) allows a user to access the ink cartridge and the media supply at the same time.

The consumables container (120) is removably coupled to the assembly housing (110). A substantial portion of the consumables container (120) may be contained within or surrounded by the assembly housing (110).

In some embodiments, the assembly housing (110) also has an indicator detector (130) coupled thereto. As will be discussed in more detail below, the indicator detector (130) detects the presence of an indicator on the consumables container (120). If the indicator is present on the consumables container, the nozzles of the ink cartridge in the consumables container (120) are covered and are not ready for use.

Figure 2A:
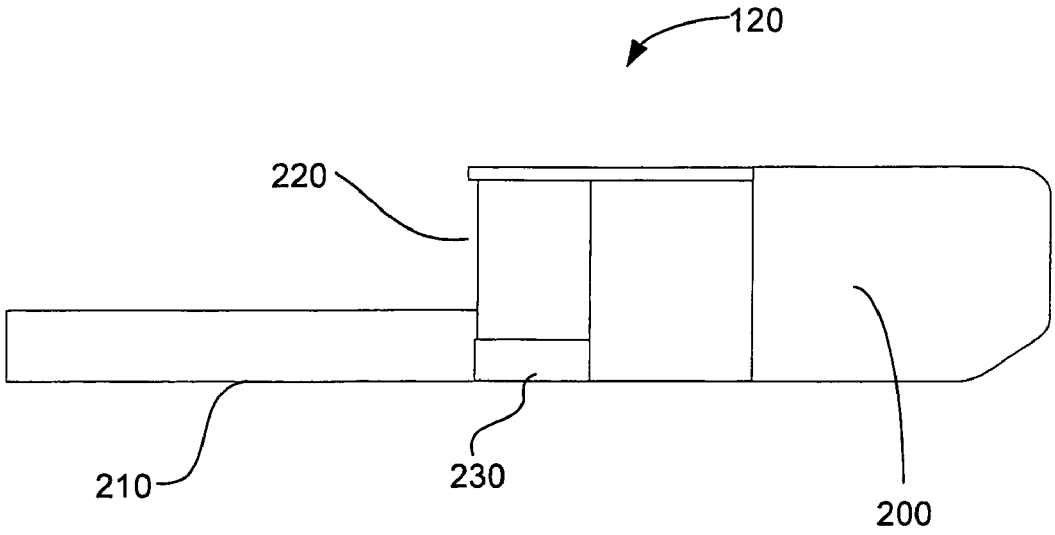
FIG. 2A illustrates a side view of an exemplary consumables container.
Figure 2B:
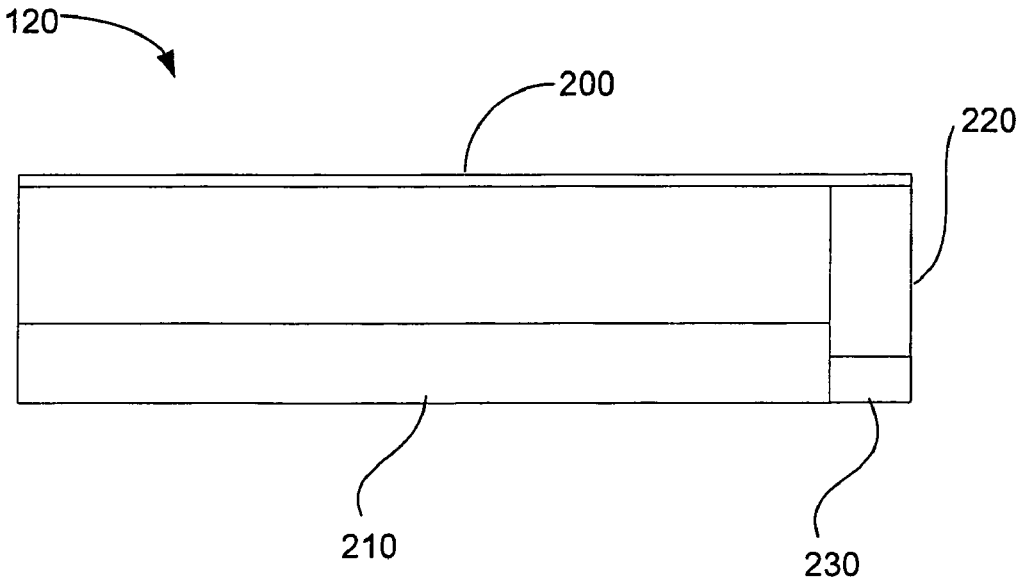
FIG. 2B illustrates a front view of the consumables container shown in FIG. 2A.

FIGS. 2A and 2B illustrate the assembled consumables container (120) in more detail. The consumables container (120) includes a consumables container housing (200), a print media supply (210) and a cartridge assembly (220). The consumables container housing (200) is configured to have the print media supply (210) and the cartridge assembly (220) each replaceably coupled thereto. Each of these components and their interaction will be discussed in more detail below.

The print media supply (210) is configured to be accessible to the printing device (100; FIG. 1) when the consumables container (120) is installed. The media may be any media on which the printing device (100; FIG. 1) can print an image. In some embodiments, the print media supply (210) is a stack of media sheets, such as sheets of paper, vinyl, cardstock, transparencies, or photographic media.

In addition, the print media supply (210) may include a tray for holding the print media. The tray may have an end that is open or configured to open as the tray is coupled to the consumables container housing (200) to permit sheets of print media to be pulled from the tray.

In addition to receiving the print media supply (210), the consumables container housing (200) also includes structure for receiving an ink cartridge assembly (220). This structure includes an opening defined in the consumables container housing (200). In order to couple the cartridge assembly (220) to the consumables container housing (200), the cartridge assembly (220) is placed in the opening such that the cartridge assembly (220) is substantially contained in or surrounded by the consumables container housing (200). The consumables container housing (200) also includes a cap (230) configured to cover the nozzles of a cartridge assembly (220), as will be discussed in more detail below.

Figure 3A:
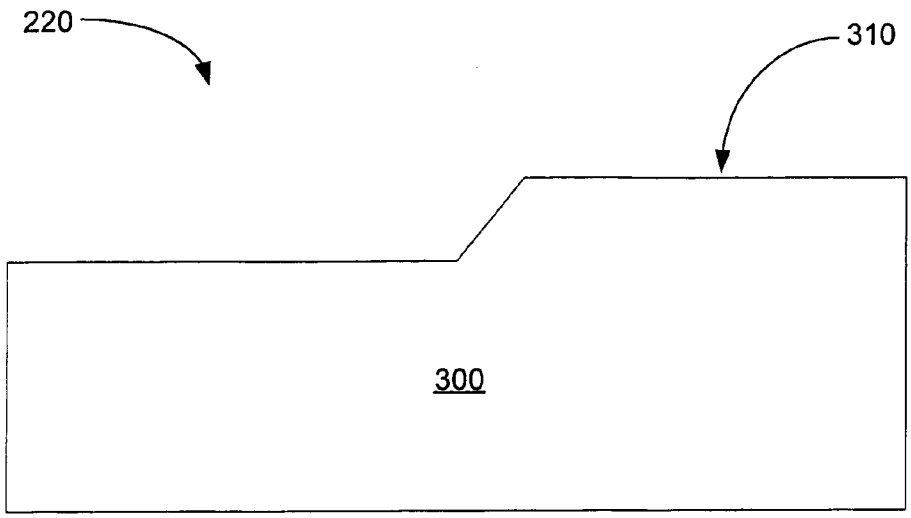
FIG. 3A illustrates a side view of an exemplary cartridge assembly.
Figure 3B:
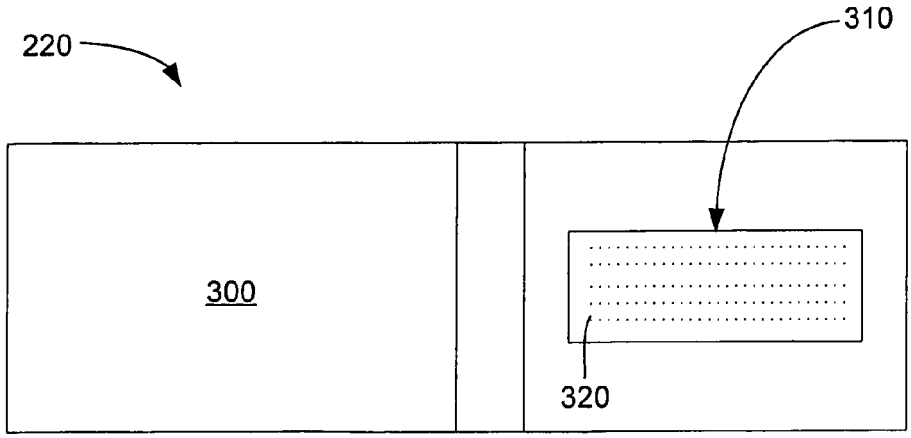
FIG. 3B illustrates a top view of the cartridge assembly shown in FIG. 3A.

FIGS. 3A and 3B illustrate a cartridge assembly (220) in more detail. The cartridge assembly (220) generally includes an ink reservoir (300) and a print head (310). The print head (310) includes an array of nozzles (320) defined therein. As noted above, these nozzles may alternatively not be formed as a print head, but may instead deliver ink to a remote print head.

In either case, several factors can limit proper operation of the cartridge assembly (220) and thereby impair the operation of the printing device (100; FIG. 1). Some of these factors include clogging of the nozzles (320) by contaminants or drying ink and damage to the nozzles by impact or other forces. The cap (230; FIG. 2) may help to minimize the effect of these factors by providing protection from foreign particles and impact forces. In addition, the cap (230) provides a properly vented, yet adequately moist, environment. This moist environment slows evaporation of the ink, thereby minimizing the amount of dried ink in the nozzles (320).

Other factors affecting the proper operation of the cartridge assembly (220) may include large temperature or pressure variations. These variations, which frequently occur during shipping, may cause ink to leak from the cartridge assembly (220) into the rest of the consumables container (120). In such instances, the ink may contaminate the media in the media supply (210; FIG. 2) and/or contaminate the rest of the consumables container (120; FIG. 2). The cap (230; FIG. 2) provides some protection against contamination due to ink drooling in response to these temperature and/or pressure variations. However, nozzle tape is typically placed over the nozzle array to eliminate this possibility of ink drool prior to the cartridge assembly (220) being installed for use. As noted above, when the cartridge assembly (220) is installed for use, the nozzle tape must be removed.

Figure 4:
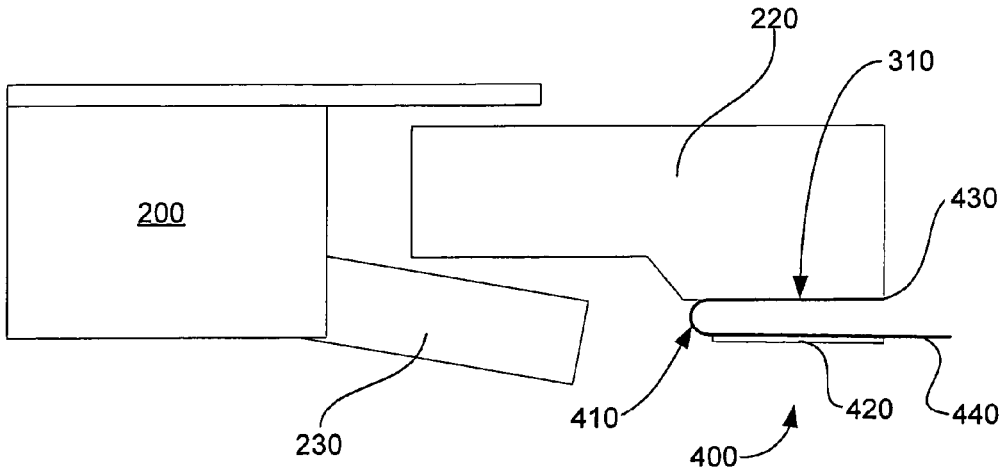
FIG. 4 illustrates a partial exploded view of a consumables container housing with a cap and a cartridge assembly having a nozzle shield assembly coupled thereto according to one exemplary embodiment.

FIG. 4 illustrates an exploded view of a portion of the consumables container (120), and shows the cap (230) in more detail. A nozzle shield assembly (400) is shown coupled to the print head (310) of the cartridge assembly (220). As shown in FIG. 4, the nozzle shield assembly (400) is configured to be placed between the cap (230) and the cartridge assembly (220). The nozzle shield assembly (400) includes a ribbon of nozzle tape (410) or other material and a cap shield (420).

The nozzle tape (410) includes a lead or standing end (430) that covers the nozzles of the print head (310) of the cartridge assembly (220). With the nozzle tape (410) covering the nozzles of the print head (310) ink drooling is effectively prevented prior to the tape (410) being removed and the unit being placed in service. The nozzle tape (410) also includes a tag end (440) that is pulled to remove the nozzle tape (410) just before the unit is placed in service. The cap shield (420) is coupled to the nozzle tape (410) near the tag end (440).

An adhesive is placed on one or a first side (450) of the nozzle tape (410). With this adhesive, the standing end (430) is secured to the print head (310) over the nozzle array, and the cap shield (420) is coupled to the nozzle tape (410). The second side (460) of the nozzle tape (410), which is opposite the first side (450), does not have adhesive placed thereon.

The nozzle tape (410) is folded on top of itself to form a fold or a half-loop. This fold brings portions of the second or non-adhesive side (460) of the tape (410) into contact. The fold does not cause the tape (410) to adhere to itself because only the non-adhesive portions (460) of the tape (410) come into contact. This configuration allows for easy removal of the nozzle shield assembly (400) as will be discussed in more detail below. In other exemplary embodiments, the nozzle tape (410) is heat staked to the cartridge assembly (220).

As noted, the standing end (430) of the nozzle tape (410) covers the nozzle array (320; FIG. 3B) of the print head (310) to form a seal thereon. By sealing the nozzles (320; FIG. 3B) with nozzle tape (410), the nozzle shield assembly (400) is able to minimize leakage and other detrimental effects that may occur due to temperature and/or pressure variations or other factors.

Typically, the nozzle tape (410) is relatively thin and clear. These characteristics allow the nozzle tape (410) to be quickly applied while allowing quality control inspectors to view the nozzles through the nozzle tape.

Once the cartridge assembly (220) is installed in the consumables container housing (200), the cap (230) covers and protects the print head (310). However, the relatively thin nozzle tape (410) may be damaged by contact with the cap (230) due to vibration or other relative movement of the nozzle tape (410) with respect to the cap (230) or other objects. If the relatively thin nozzle tape (410) is damaged, attempts to remove the nozzle tape (410) may fail. For example, if the nozzle tape (410) becomes split longitudinally, attempts to remove the tape may cause a portion of tape on one side of the split to remain in contact with the cartridge assembly (230) as the portion on the other side of the split is removed. Further, the nozzle tape (410) may be damaged in any number of ways that cause attempts to remove the nozzle tape (410) to fail.

Consequently, the cap shield (420) is used to minimize damage to the nozzle tape (410) by preventing contact between the cap (230) and the portion of the nozzle tape (410) that is over the nozzles of the print head (310). In the absence of the cap shield (420), the movement of the cap (230) with respect to the cartridge assembly (220) may cause the cap (230) to contact the nozzle tape (410). This contact may be cause damage or abrasion to the nozzle tape (410).

When the nozzle shield assembly (400) is in place on the cartridge assembly (220) and the cartridge assembly (220) is coupled the consumables container housing (200), the cap shield (420) is located at least partially between the cap (230) and the nozzle tape (410). As a result, vibration or movement of the cap (230) with respect to the cartridge assembly (220) causes the cap (230) to contact the cap shield (420) rather than the nozzle tape (410). The cap shield (420) is of a sufficiently sturdy material that this contact does not substantially affect the nozzle tape (410). Examples of the material from which the cap shield (420) can be made include plastic or cardboard.

The nozzle shield assembly (400) also provides for rapid and convenient removal of the nozzle tape (410) from the cartridge assembly (220). As discussed above, the second or non-adhesive side (460) of the nozzle tape (410) is folded on top of itself to form a fold or a half-loop such that a portion of the tag end (440) extends beyond the cap shield (420). (See FIG. 4). This portion is accessible to a user when the cartridge assembly (220) is coupled to the consumables container housing (200).

The loop allows a user to remove the nozzle shield assembly (400) without removing the cartridge assembly (220) from the consumables container housing (200). Removing the cartridge assembly (220) is accomplished by pulling on the portion of the tag end (440) that extends beyond the cap shield (420). By pulling on the tag end (440) of the nozzle tape (410), the cap shield (420) is drawn out from within the cap (230). As a user continues to pulls on the tag end (440) of the nozzle shield assembly (400), the nozzle tape (410) slides on itself. The loop decreases until the standing end (430) of the nozzle tape (410) is removed or pulled from the print head (310), exposing the print head (310) of the cartridge assembly (220).

The cap (230) is hinged or pivotingly coupled to the consumables container housing (200). A spring or biasing member biases the cap (230) toward the cartridge assembly and away from the position shown in FIG. 4. Thus, the cap (230) can be moved to provide space between the cap (230) and the consumables container housing (200). This allows for the cartridge assembly (220) to be coupled to the consumables container housing (200). Once the cartridge assembly (220) has been coupled to the consumables container housing (200), the spring urges the cap (230) into position over the print head (310). After the nozzle shield assembly (400) is removed, the cap (230) protects the print head (310), as previously described.

As discussed with reference to FIG. 4, protection of the nozzle tape by the cap shield improves the reliability and ease with which the nozzle shield assembly can be removed by preventing damage to the nozzle tape that would other wise make the nozzle tape difficult to remove. However, it is also important to remove the nozzle tape before installing the consumables container in a printing device. Otherwise, the cartridge assembly cannot function.

Accordingly, an indicator can also be included to indicate that the nozzle tape is attached to a cartridge assembly. The indicator may be coupled to the nozzle tape and then wrapped around the cartridge assembly and a consumables container housing to which the cartridge assembly is attached. Such an indicator will be visible from all angles of the consumables container housing. This visibility reduces the possibility that a user will unintentionally attempt to couple the consumables container to an assembly housing of the printing device while the nozzle shield assembly is still in place.

Figure 5A:
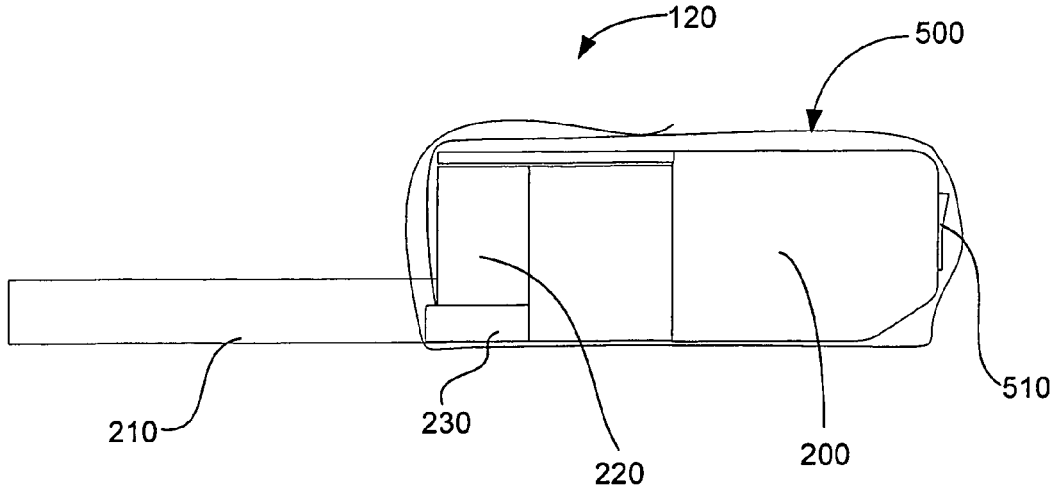
FIG. 5A illustrates a side view of a consumables container having an indicator coupled thereto according to one exemplary embodiment.
Figure 5B:
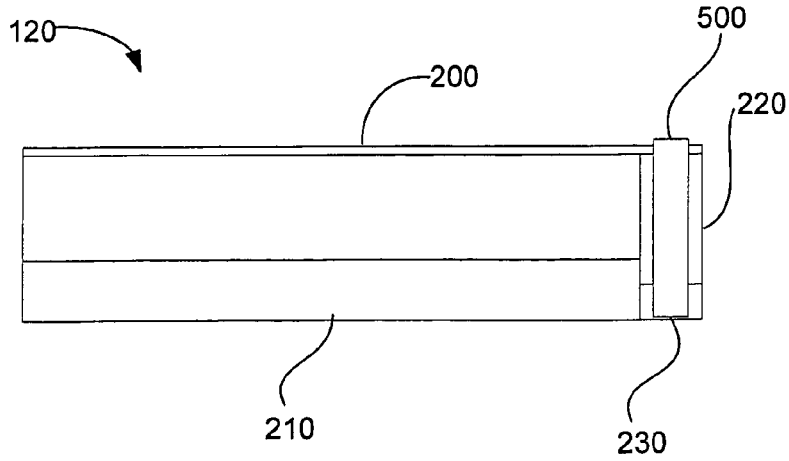
FIG. 5B illustrates a front view of the consumables container shown in FIG. 6A.

An embodiment of this indicator is illustrated in FIG. 5. As shown in FIG. 5, the indicator (500) may be wrapped around the consumables container housing (200) and cartridge assembly (220). In this location, the indicator (500) reminds the user that the nozzle shield assembly must be removed before the cartridge assembly (220) can be used. This minimizes the possibility that a user will unintentionally attempt to couple the consumables container (120) to the assembly housing (110; FIG. 1) of the printing device without removing the nozzle shield assembly (400; FIG. 4).

The indicator (500) may be connected to the tag end (440; FIG. 4) of the nozzle shield assembly (400; FIG. 4). Consequently, removing the indicator (500) and removing the nozzle shield assembly (400; FIG. 4) may be performed in a single action.

The indicator (500) is visible from all angles of the consumables container because it is wrapped around the entire housing. This three-dimensional presence reminds a user to remove the nozzle shield assembly (400; FIG. 4).

The indicator (500) may have instructions printed thereon reminding the user to remove the indicator (500) and/or the nozzle tape. These instructions may be either textual or graphic.

In addition, the indicator (500) may be wrapped on itself such that there is a double thickness of indicator (500) along some portions of the consumables container housing (200), such as on the top of the consumables container housing (200). The double thickness of the indicator (500) makes it difficult to couple the consumables container (120) to the assembly housing (110; FIG. 1) because the indicator (500) is likely to interfere with either the assembly housing or with an indicator detector (130; FIG. 1). The indicator detector (130; FIG. 1) may simply be a pin that interferes with the indicator (500), if the indicator (500) is still on the consumables container housing (200) when the user attempts to couple the consumables container (120) to an assembly housing (110; FIG. 1).

Additionally, a switch (510) is shown in the consumables container housing (200). The switch (510) is an engagement mechanism that places the cartridge assembly (220) in an engaged position with the assembly housing (110; FIG. 1). For example, electrical circuitry in the cartridge assembly (220) may engage corresponding electrical circuitry in the assembly housing (110) when the switch (510) is engaged.

While the indicator (500) is in place, the indicator covers the switch (510). As a result, the indicator (500) prevents use of the switch until the indicator (500) is removed. This further minimizes the possibility that a user will unintentionally try to couple the consumables container (120) to the assembly housing (110; FIG. 1) with the indicator (500) and the nozzle shield assembly (400; FIG. 4) in place.

Figure 6:
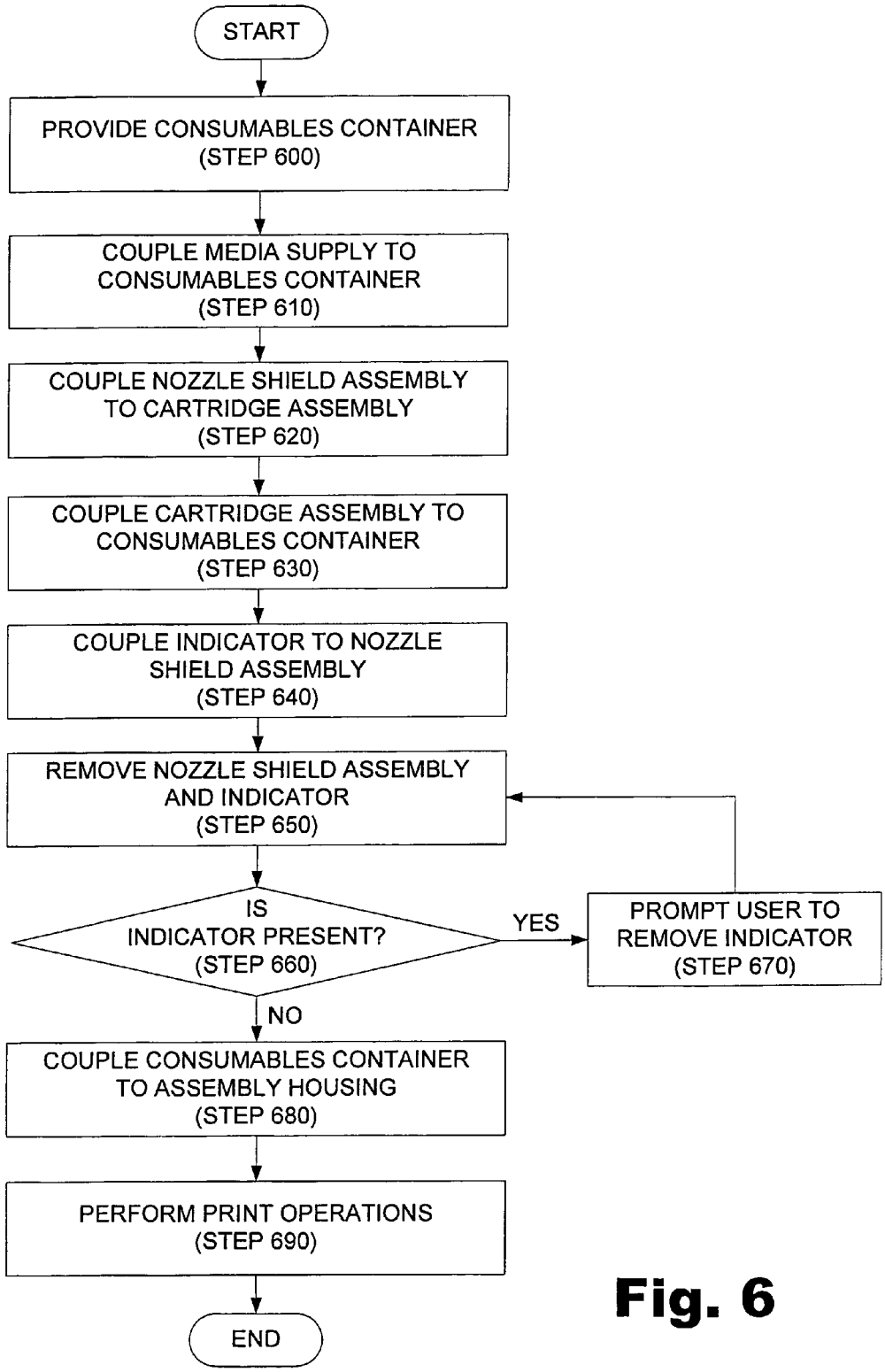
FIG. 6 is a flowchart illustrating a method of using a consumables container according to one exemplary embodiment.

FIG. 6 is a flowchart illustrating a method of using a consumables container according to one exemplary embodiment. The method begins by providing a consumables container housing (step 600). The consumables container housing is configured to receive the replaceable and/or removable components of the consumables container. These components may include the media supply, an ink cartridge assembly, and/or other replaceable and/or removable components. Further, the consumables container housing includes structure for engaging corresponding structure in a printing device, to which the consumables container is to be coupled.

The next step is to couple a media supply to the consumables container housing (step 610). The media supply may supply any type of media, as discussed above. A nozzle shield assembly is coupled to the cartridge assembly (step 620). The nozzle shield includes nozzle tape and an optional cap shield. The nozzle shield assembly is coupled to the cartridge assembly by covering an ink delivery portion of the cartridge assembly with a standing end of the nozzle tape. The tag end of the nozzle tape is then doubled over the standing end to form a fold or a loop.

The cartridge assembly is then coupled to the consumables container housing (step 630). This may include locating the cartridge assembly in such a way that the nozzle shield assembly is between a cap coupled to the consumables container assembly and the cartridge assembly. If the nozzle shield assembly includes a cap shield, the cap shield is placed between the cap and the nozzle tape.

As previously discussed, the nozzle shield assembly may be difficult to locate if a substantial portion of the cartridge assembly is covered by the consumables container housing. Further, it may be difficult to detect if the nozzle shield assembly is attached to the cartridge assembly without closely inspecting the ink delivery portion of the cartridge assembly.

An indicator may be coupled to the tag end of the nozzle shield assembly (step 640) to indicate that the nozzle shield assembly is present on the cartridge assembly. In addition, the indicator may act as an extension of the nozzle shield assembly. For example, the indicator may be a ribbon of material of a length sufficient to be wrapped around an entire perimeter of the consumables container housing and print cartridge. The standing end of the indicator may be coupled to the tag end of the nozzle shield assembly, such that the indicator and nozzle shield assembly effectively includes a long ribbon. Further, the indicator and nozzle shield assembly may be formed from a single piece of material.

The tag end of the indicator may overlap a portion of the indicator and may then be secured to an overlapped portion thereof to secure the indicator in place. Wrapping the indicator around the consumables container housing provides a three dimensional indication that the nozzle shield assembly is still in place, and needs to be removed.

At this point, the consumables container is ready for transport or shipping. Once the consumables container is ready to be coupled to the printing device, the indicator and nozzle shield assembly are removed (step 650). Removal of the indicator and nozzle shield assembly begins by unwrapping the indicator from the consumables container housing and the cartridge assembly. Once the indicator has been unwrapped, it can then be used as a grip to pull on the tag end of the nozzle shield assembly and thereby remove the nozzle shield assembly as previously discussed. The nozzle shield assembly can thus be removed from the cartridge assembly by pulling on either the tag end of the nozzle tape or by pulling on the indicator if the indicator is coupled to the tag end nozzle tape.

As the consumables container is coupled to the assembly housing, the printing device may check for the presence of the indicator (step 660). To accomplish this, the printing device may optionally have an indicator detector pin located in the assembly housing that minimizes the possibility that the consumables container would be coupled to the assembly housing with the indicator still attached.

The indicator detector pin is a pin that interferes with the indicator if the indicator remains in place on the consumables container as a user attempts to the couple the consumables container to the assembly housing. More specifically, the indicator detector pin is positioned such that a small gap exists between the detector pin and the consumables container as the consumables container is coupled to the assembly housing. This gap may be less than the thickness of one or more layers of the indicator. As a result, if the indicator is still coupled to the consumables container, the indicator detector pin interferes with the coupling of the consumables container to the assembly housing.

In addition, the indicator detector pin may have a sensor coupled thereto. As a result, contact with the indicator detector pin may activate the sensor and thus inform the printing device that the indicator is still present. In other embodiments, the indicator detector may, itself, be an electronic sensor that detects the presence or absence of the indicator on the consumables container and prompts the user to remove the indicator if it remains at the time of installation.

In the case that the indicator contacts the indicator detector (YES, step 660), the printing device provides a prompt to an interface portion to remove the indicator (step 670). If the user removes the indicator and nozzle shield assembly and again attempts to coupled the consumables container to the assembly housing, the indicator detector again determines whether the indicator is present (step 660).

If the indicator has been removed, the consumables container slides past the indicator detector and the printing device does not detect the presence of the indicator (NO, step 660). The consumables container is then coupled to assembly housing (step 680). Once the indicator detector determines that the indicator has been removed, the printing device, with the consumables container now attached, is able to perform print operations as normal (step 690).

In conclusion, a nozzle shield assembly protects an ink delivery portion of an ink cartridge during shipping, transport, storage or other periods and minimizes the possibility that the cartridge assembly will become damaged or contaminated. This protection may be enhanced by including a cap shield with the nozzle shield assembly. An indicator may be included with the nozzle shield assembly to indicate that the nozzle shield assembly is placed on the cartridge assembly and thereby reduce the possibility that a user would unintentionally attempt to couple the consumables container to a printing device without removing the nozzle shield assembly.

The preceding description has been presented only to illustrate and describe the present method and apparatus. It is not intended to be exhaustive or to limit the disclosure to any precise form disclosed. Many modifications and variations are possible in light of the above teaching. It is intended that the scope of the invention be defined by the following claims.

What is claimed is:

1. A method of protecting a cartridge assembly comprising a print head with an array of electronically controlled nozzles for selectively depositing ink, said method comprising:

covering said array of electronically controlled nozzles of said print head of said cartridge assembly with a standing end of a ribbon of nozzle tape;

folding a tag end of said nozzle tape over said standing end of said ribbon and said array of electronically controlled nozzles for selectively depositing ink; and coupling an indicator to said tag end of said nozzle tape, in which said indicator is positioned to cover a switch on said cartridge assembly, said switch being operable for engaging said cartridge assembly when installed in a printing device.

2. The method of claim 1, further comprising coupling a cap shield to said tag end of said nozzle tape.

3. The method of claim 1, wherein coupling said indicator to said nozzle tape includes coupling a standing end of said indicator to said tag end of said nozzle tape.

4. The method of claim 1, further comprising wrapping said indicator completely around a perimeter of said cartridge assembly and a consumables container housing.

5. The method of claim 1, further comprising wrapping a length of said indicator around an entire perimeter of said cartridge assembly.

6. The method of claim 1, wherein at least said standing end of said nozzle tape covering said nozzles is transparent.

7. The method of claim 1, further comprising:

applying an adhesive to a first side of said nozzle tape; and using said adhesive to attach said standing end over said nozzles;

wherein a second side of said nozzle tape without said adhesive contacts itself due to said folding.

8. The method of claim 7, further comprising attaching a cap shield to said first side of said nozzle tape such that, following said folding, said cap shield is disposed over said nozzles with said standing end and said folded tag end of said nozzle tape being disposed between said cap shield and said nozzles.

9. The method of claim 1, further comprising disposing said indicator such that said indicator will interfere with a member of a printing device if said indicator is still in place when said cartridge assembly is installed in said printing device.

10. A method of protecting a cartridge assembly with nozzle tape and indicating that nozzle tape is attached to said cartridge assembly when said cartridge assembly is coupled to a consumables container, wherein said cartridge assembly comprises a print head with an array of electronically controlled nozzles for selectively depositing ink, wherein an end of said nozzle tape is applied covering and protecting said array of nozzles, and wherein said cartridge assembly is coupled to a consumables container;

said method comprising:

coupling an indicator to said nozzle tape; and wrapping said indicator completely around said cartridge assembly and said consumables container.

11. The method of claim 10, and further comprising providing instructions on said indicator for removal of said indicator and said nozzle tape.

12. The method of claim 10, further comprising:

covering nozzles of said cartridge assembly with a standing end of said nozzle tape; and folding a tag end of said nozzle tape over said standing end of said nozzle tape and said nozzles.

13. The method of claim 12, further comprising coupling said indicator to said tag end of said nozzle tape.

14. The method of claim 12, further comprising coupling a cap shield to said tag end of said nozzle tape.

15. The method of claim 14, further comprising positioning said cap shield such that said cap shield is disposed over said nozzles, with said standing end and said folded tag end of said nozzle tape being disposed between said cap shield and said nozzles.

16. The method of claim 12, wherein at least said standing end of said nozzle tape covering said nozzles is transparent.

17. The method of claim 12, further comprising:

applying an adhesive to a first side of said nozzle tape; and using said adhesive to attach said standing end over said nozzles;

wherein a second side of said nozzle tape without said adhesive contacts itself due to said folding.

18. The method of claim 17, further comprising attaching a cap shield to said first side of said nozzle tape using said adhesive such that, following said folding, said cap shield is disposed over said nozzles, with said standing end and said folded tag end of said nozzle tape being disposed between said cap shield and said nozzles.

19. The method of claim 10, further comprising disposing said indicator such that said indicator will interfere with a member of a printing device if said indicator is still in place when said cartridge assembly is installed in said printing device.

20. The method of claim 10, wherein said indicator is positioned to cover a switch on said cartridge assembly, said switch being operable for engaging said cartridge assembly when installed in a printing device.

21. A method of protecting a cartridge assembly comprising:

covering nozzles of said cartridge assembly with a standing end of a ribbon of nozzle tape;

disposing a cap shield on said nozzle tape;

folding a tag end of said nozzle tape over said standing end of said ribbon and said nozzles; and positioning said cap shield such that, following said folding, said cap shield is disposed over said nozzles, with said standing end and said folded tag end of said nozzle tape between said cap shield and said nozzles.

* * * * *